United States Patent [19]

Wrench

[11] Patent Number: 4,606,123

[45] Date of Patent: Aug. 19, 1986

[54] CUTLERY APPARATUS WITH INTERCHANGEABLE CUTTING TOOL

[75] Inventor: Robert A. Wrench, Renton, Wash.

[73] Assignee: Wraven Products Inc., Seattle, Wash.

[21] Appl. No.: 665,444

[22] Filed: Oct. 26, 1984

Related U.S. Application Data

[63] Continuation-in-part of Ser. No. 503,023, Jun. 10, 1983, abandoned.

[51] Int. Cl.[4] ..... B26B 1/04

[52] U.S. Cl. ..... 30/153; 30/156; 30/161; 30/154

[58] Field of Search ..... 30/151, 161, 156, 153, 30/154, 155, 329, 330, 331

[56] References Cited

U.S. PATENT DOCUMENTS

| | | | |
|---|---|---|---|
| Re. 19,606 | 3/1958 | Henn | 30/156 X |
| 821,176 | 5/1906 | Leland | 30/161 X |
| 978,165 | 12/1910 | Johnson | 30/161 |
| 1,036,664 | 8/1912 | Marble | 30/161 X |
| 2,419,168 | 5/1947 | Schuster | 30/155 |
| 2,512,238 | 6/1950 | Nakamura | 30/161 X |
| 3,699,654 | 10/1972 | Gerling | 30/155 |
| 4,083,110 | 4/1978 | Goldin | 30/155 |
| 4,227,303 | 10/1980 | Brooker | 30/154 |
| 4,425,709 | 1/1984 | Quenzi | 30/151 |

FOREIGN PATENT DOCUMENTS

| | | | |
|---|---|---|---|
| 130557 | 10/1901 | Fed. Rep. of Germany | 30/161 |
| 1770 | of 1885 | United Kingdom | 30/161 |

OTHER PUBLICATIONS

Publication entitled "First Annual Edition Knives '81", edited by Ken Warner, p. 40.

*Primary Examiner*—Jimmy C. Peters
*Attorney, Agent, or Firm*—Graybeal & Cullom

[57] ABSTRACT

Cutlery apparatus with readily interchangeable cutting tools such as knives, the cutting tools being either double ended or a plurality of single ended tools pivotally mounted in a handle, either directly between the handle sides or on a generally U-shaped tool holding member which is in turn pivotally movable in and out of a slotted handle, the apparatus being further provided with lock arm means also pivotally mounted on the handle, forming a part of the handle when closed and retaining the tool rigidly in the handle without use of spring means when the tool is locked in the handle in a position of use. The apparatus which in certain embodiments is of a type commonly called swap blade knives, is readily disassembleable for tool interchange or cleaning. Double ended knives embodying the invention have the strength of a full tang knife with the versatility of a multi-bladed folding knife. Like handle sides, like lock arms, and cutting tools of like construction insofar as the pivot component and locking component portions thereof, are utilized in certain forms of the apparatus, to simplify fabrication and facilitate interchangeability of parts.

24 Claims, 36 Drawing Figures

SAW

GUT HOOK

SKINNING BLADE

DESCALER

FISH BLADE

HOOK REMOVER

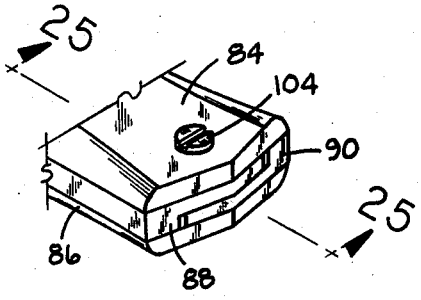
FIG 24
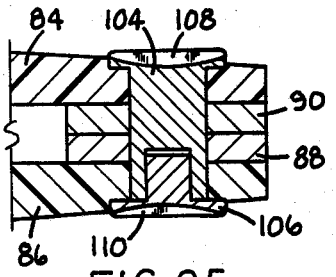
FIG 25
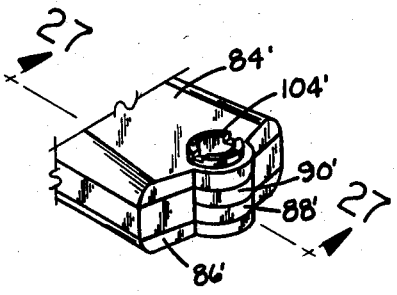
FIG 26
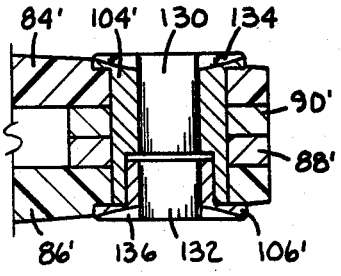
FIG 27
FIG 28
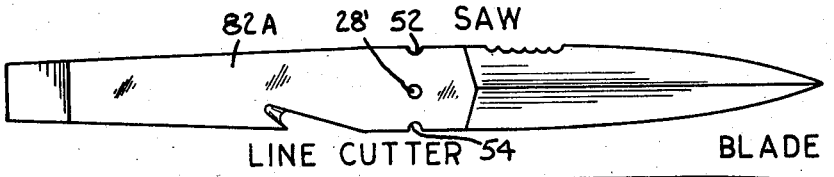
FIG 29
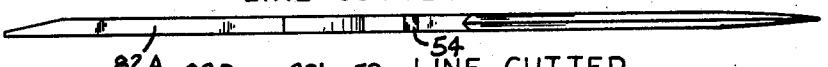
FIG 30
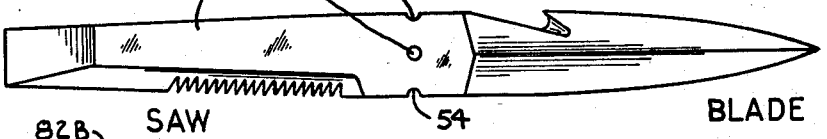
FIG 31
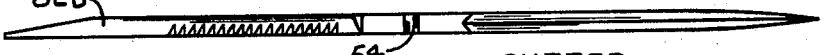
FIG 32
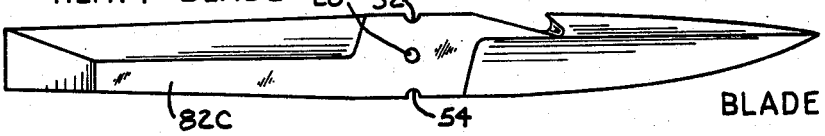
FIG 33
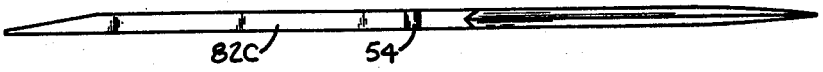

CUTLERY APPARATUS WITH INTERCHANGEABLE CUTTING TOOL

CROSS REFERENCE TO RELATED APPLICATION

This application is a continuation-in-part of application Ser. No. 503,023, entitled Cutlery Apparatus, filed June 10, 1983 and now abandoned.

FIELD OF THE INVENTION

The present invention in general relates to cutlery and in particular to simple and compact multi-function cutlery apparatus comprising pivotal double ended or single ended cutting tools in combination with a slotted handle, the cutlery tool(s) being uniquely configured to be rigidly lockable with respect to the handle for use and without need for spring means in the handle, and being pivotally movable with respect to the handle for ready reversal end for end or replacement.

BACKGROUND ART

In multi-function cutlery apparatus, of which pocket knives are but one example, it is desirable to provide a basic handle apparatus with a quick and simple means for interchangeably mounting separate cutting tools as well as means for pivotally positioning the tool in functional position once the tool is mounted on the handle apparatus. Furthermore, it is also desirable to provide a positive locking means, without spring means, for locking the cutting tool in fixed position for use.

In the past such cutlery apparatus have not provided, nor were they designed to provide, almost instantaneous interchangeability of cutting tools. Brooker U.S. Pat. No. 4,227,303 discloses a knife comprising an arm member with a knife blade pivotally and permanently attached thereto, which is pivotally mounted on a slotted handle by means of a removable screw. The purpose of mounting the arm and knife blade combination in this manner is to facilitate cleaning of the apparatus. Although this feature aids in the cleaning of the apparatus, it does not provide a practical means for changing cutting tools in the manner intended for the invention disclosed herein. Brooker also discloses a means for pivoting the knife blade in and out of position for use, as do Goldin et al U.S. Pat. No. 4,083,110, Gerling U.S. Pat. No. 3,699,654, and Schuster U.S. Pat. No. 2,419,168. Indeed, such pivotability of cutting tools appears to be rather well known to the art. Of the patents listed above only Brooker U.S. Pat. No. 4,227,303 discloses pivoting a cutting tool about an independently pivoting arm member. However, the Brooker knife blade pivots about an axis that is transverse to the pivotal axis of the arm member and that the arm member is single armed. In contrast, the interchangeable cutting tool(s) of the present invention pivot about an axis transverse to the thickness of the handle and are mounted on the handle in conjunction with lock arm means also pivotal with respect to the handle about a pivot axis parallel to the pivot axis of the cutting tool(s). These differences are considered essential to the improved tool interchangeability characteristics and simplicity embodied in the present invention. Brooker is also known to market a version of the apparatus shown in his patent wherein the blade means is double-ended, but in this version also the axis about which the blade means pivots is transverse to the pivot axis of the arm member.

All of the above-discussed patents provide some means of holding a cutting tool in a fixed position with respect to the handle. However, none teaches using an independently pivotal lock arm means such as that utilized in cutting apparatus according to the present invention.

SUMMARY OF THE INVENTION

It is the principal object of this invention to provide compact multi-function cutlery apparatus, such as what are commonly called swap blade knives, for example, incorporating quick and simple means for interchangeably mounting an assortment of pivotally mounted, single and double ended cutting tools.

A further object is to provide a cutting apparatus which incorporates a means for pivotally positioning and retaining a cutting tool in its various functional positions.

Another object is to provide a cutlery apparatus with a positive locking means, including unique locking components on the tool itself, whereby the cutting tool in its use position is held in fixed relation to the handle, without the use of spring means.

Other objects and features of the present invention are to provide cutlery apparatus wherein, in the handle of the apparatus, identically configured components are used for certain parts, simplifying the manufacture of the apparatus, to provide cutlery elements are made to be relatively interchangeable in a given handle form and also interchangeable between various handle forms, to provide in certain embodiments of the invention, an assembly of handle and cutlery element(s) which is strong and rigid, with handle components being bolted together at both ends, and to provide certain forms of cutlery apparatus which are readily adaptable for underwater usage simply by interchange of cutlery elements. Double-ended forms of the invention have the strength of a full tang knife with the versatility of a multi-bladed folding knife.

The present invention relates to multi-function cutlery apparatus with pivotal, readily interchangeable cutting tools. Briefly, in one form of the invention a two-armed, U-shaped tool holding member is pivotally attached near its base to one end of a slotted handle and may either be positioned within the slot or pivoted substantially clear of the slot. One or more cutting tools are pivotally mounted at the opposite end of tool holding member such that the tool(s) and the tool holding member both pivot in the same plane as the principal plane of the handle slot. In the single tool version of this embodiment, the cutting tool has trunnions on both sides that fit into opposing journals in the arms of the tool holding member. Because the arms of the tool holding member are of relatively low stiffness and easily flexed, the tool may be easily snapped in and out of its mounted position to facilitate tool changes. In a multiple-tool version of this embodiment, several tools are pivotally mounted on the arms of the tool holding member by means of removable, internally threaded screw means threaded over an opposing externally threaded screw means, with spacer means separating the tools from one another. When employing a double-ended tool, and with the tool holding member pivoted substantially clear of the handle slot, the cutting tool can be pivotally moved to either of its functional positions. For example, a double-ended tool comprising a saw on one end and a knife blade on the other can be pivoted so that either will be presented for use. A single-ended tool can be pivoted so that it is either presented for use or nested within the handle. When single-ended cutting tools are mounted on the tool holding member, any one tool can be positioned for use or nested in the handle. In addition, the cutting tool(s) can be mounted or removed when the tool holding member is in this position. When a given cutting tool is in its desired position, the tool holding member is pivoted back into a position disposed within the handle slot. In this position, that portion of the edges of the tool holding member and the cutting tool adjacent the tool mounting point are flush with the base of the handle slot. A detent in the base of the handle slot engages opposing depressions in the adjacent edges of the tool holding member and the tool to ensure that both are properly positioned. Once the tool and tool holding member are in this position, a pivoted lock arm, pivotally mounted on the handle adjacent to the mounting point of the tool holding member and pivotable along a parallel axis, can be pivoted until it is disposed within the handle slot with the locking portion thereof flush against that portion of the edges of the tool holding member and cutting tool adjacent the tool mounting point. The locking portion of the lock arm has two detents which are perpendicular to one another. One detent engages opposing depressions in the tool holding member and the cutting tool to help retain both in position. The other detent engages an opposing depression in the side of the handle slot to positively retain the lock arm in closed position and thus retain the cutting tool and tool holding member in fixed relation to the handle. A serrated surface on the locking portion of the lock arm provides a gripping means enabling the lock arm to be pivoted from its locked position.

In a second preferred form of the invention, two spaced handle sides span a double-ended cutlery element mounted at one end of the handle sides for pivotal movement parallel to the width of the sides and lockable in use position relative to the handle sides by lock arms mounted for pivotal movement at the other end of the handle sides and including locking detent component means at the free ends of the lock arms which interfit with locking detent component means situated at the sides of the cutlery element, such lock arms when in locking engagement with the cutlery element being configured to enclose the space between the handle sides and form a structural part of the handle means grippable by a user of the cutlery appratus. The handle sides are preferably identical to each other, as are the lock arms, and the pivot means mounting the cutlery element on the handle sides preferably includes a first pivot component in the form of a hole centrally placed in the cutlery element and, as a second pivot component, a double headed bolt assembly passing through holes at one end of the handle sides and through the pivot hole in the cutlery element, the lock arms being similarly assembled and pivotally movable with respect to the handle sides by first pivot components in the form of holes in one end of the lock arms and a second pivot component in the form of double headed bolt means passing through holes at the other end of the handle sides and the pivot holes in the ends of the lock arms. The cutlery element also includes locking detent components at the sides thereof laterally of the pivot hole, each of which interfits with a mating locking detent component at the free end of the associated lock arm to lock the cutlery element in the handle in its selected position of use when the lock arms are pivotally closed into the space between the handle sides. A wide variety of cutlery elements, both single ended and double ended, and provided with like pivot holes and locking detent components can be provided as a set, each of which is alternatively usable as desired, with several of the forms of handle means disclosed, (e.g. the form of handle means including the tool holder with pin as hereinafter discussed in connection with FIG. 5A, and the form of handle means disclosed at FIGS. 18–21, for example).

These and other objects, features, advantages and characteristics of cutlery apparatus according to the present invention will be apparent from the accompanying drawings and following description of preferred embodiments thereof.

BRIEF DESCRIPTION OF THE DRAWINGS

FIG. 24 is an isometric, fragmentary detail view on an enlarged scale of the handle end of the form of the invention shown in FIGS. 18–23, to which the lock arms are pivotally mounted.

FIG. 25 is a cross-sectional view of the handle end shown in FIG. 25, taken substantially along line 25—25 thereof.

FIG. 26 is an isometric fragmentary detail view, also taken on an enlarged scale, of the handle end of a form of the invention shown in FIGS. 18–25, which has been modified to include a somewhat larger double headed bolt means as the pivot component mounting the lock arms, such enlarged bolt means including an axial opening therethrough for reception of a wrist lanyard or the like.

FIG. 27 is a cross-sectional view of the form of handle end shown in FIG. 26, taken substantially along line 27—27 thereof.

FIG. 28 is a plan view of a further form of double-ended cutting tool for use in the apparatus of the present invention, comprising a chisel and line cutter on one end a saw and blade on the other end.

FIG. 29 is an edge view of the cutting tool shown in FIG. 28.

FIG. 30 is a plan view of yet another form of such double ended cutting tool, comprising a chisel and saw on one end and a line cutter and blade on the other end.

FIG. 31 is an edge view of the cutting tool shown in FIG. 30.

FIG. 32 is a plan view of yet another form of such double ended cutting tool, comprising a chisel and heavy blade on one end and a line cutter and lighter blade on the other end.

FIG. 33 is an edge view of the cutting tool shown in FIG. 32.

DESCRIPTION OF THE PREFERRED EMBODIMENTS

Figure 1:
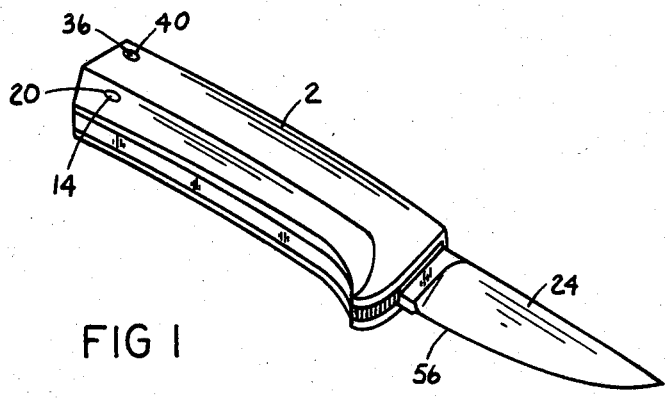
FIG. 1 is an isometric view of a first form of cutlery apparatus constructed in accordance with the present invention.
Figure 2:
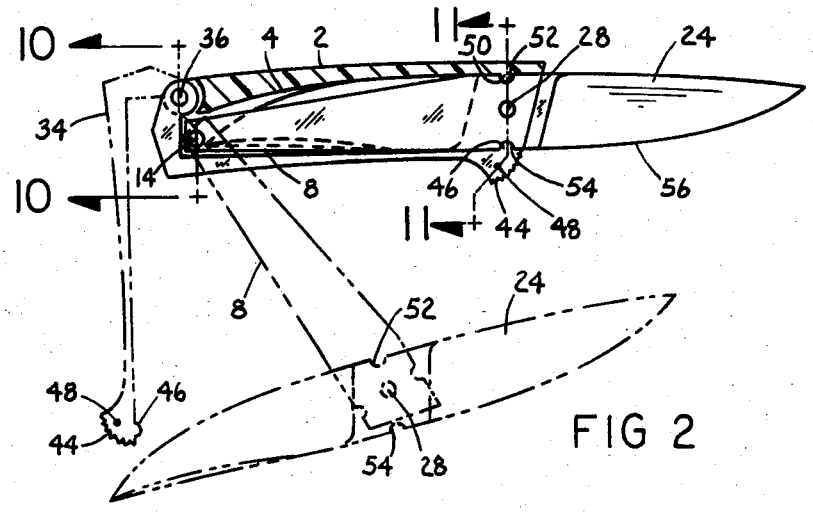
FIG. 2 is a plan view, partly in cross-section, of the apparatus shown in FIG., 1, with the double-ended cutting tool thereof depicted in its locked and unlocked positions.
Figure 15:
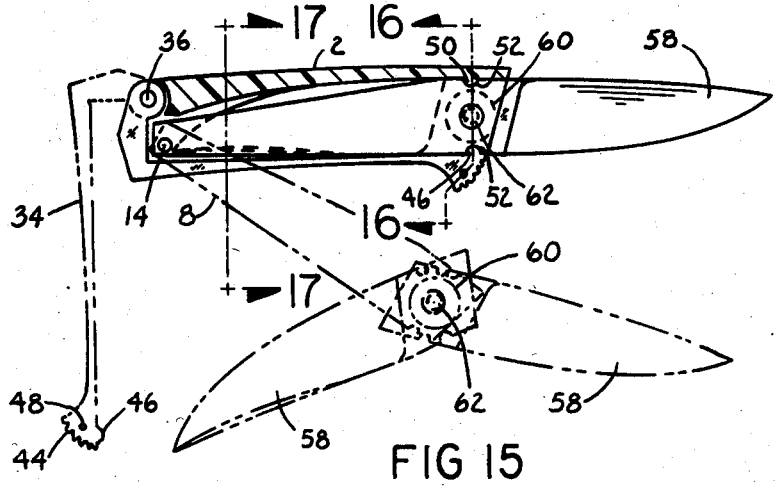
FIG. 15 is a plan view, partly in cross-section, of a multiple, single-ended tool embodiment of cutlery apparatus according to the present invention, depicting it in its locked and unlocked positions.
Figure 16:
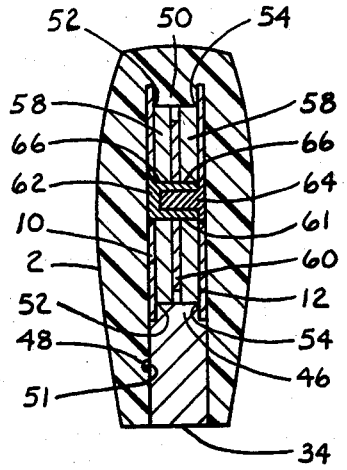
FIG. 16 is a cross-sectional view taken along line 16—16 of FIG. 15.
Figure 17:
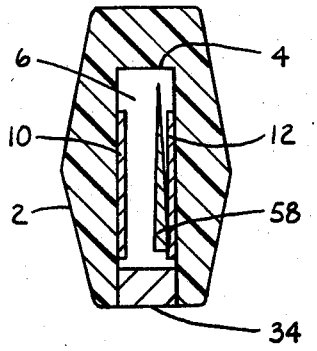
FIG. 17 is a cross-sectional view taken along line 17—17 of FIG. 15.
Figure 18:
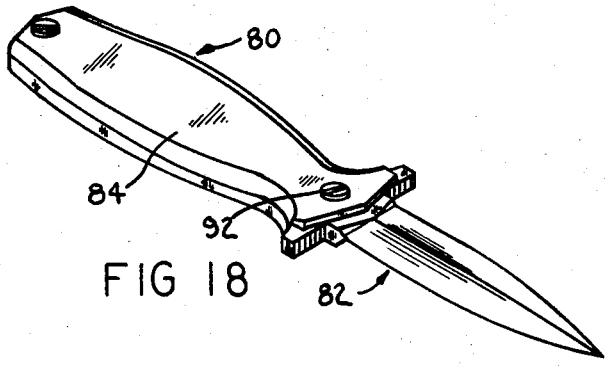
FIG. 18 is an isometric view of a second form of cutlery apparatus constructed in accordance with the present invention, utilizing two identical lock arms and two identical handle sides.
Figure 19:
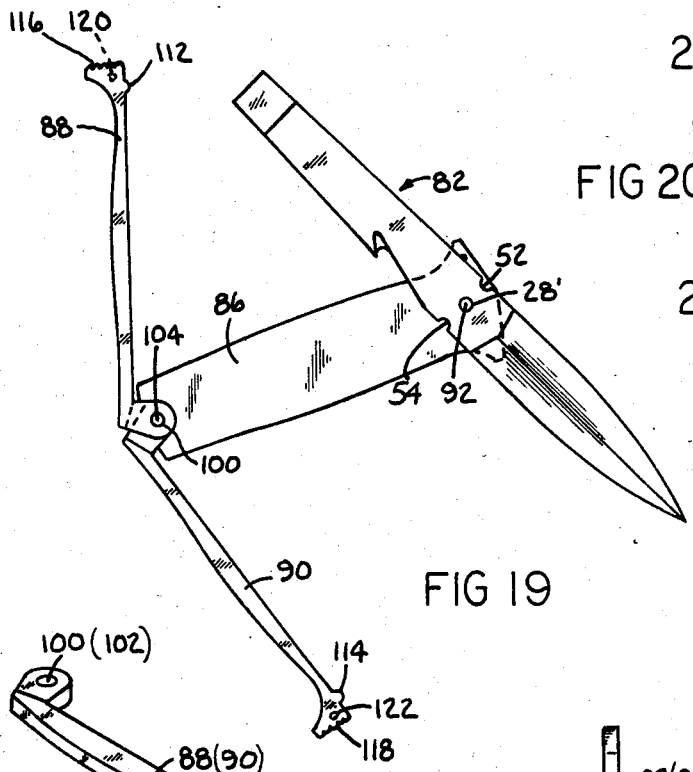
FIG. 19 is a plan view, partly in cross seotion, of the apparatus shown in FIG. 18, with the lock arms open and the cutting tool pivotally moved from its normal, in use position.
Figure 20:
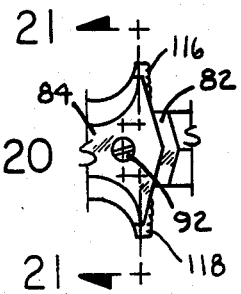
FIG. 20 is a fragmentary view in side elevation of the form of apparatus shown in FIGS. 18 and 19, with the cutting tool in its position of use and with the lock arms in tool locking position.
Figure 21:
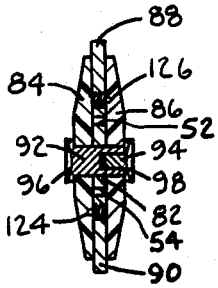
FIG. 21 is a cross-sectional view taken substantially along line 21—21 of FIG. 20.
Figure 22:
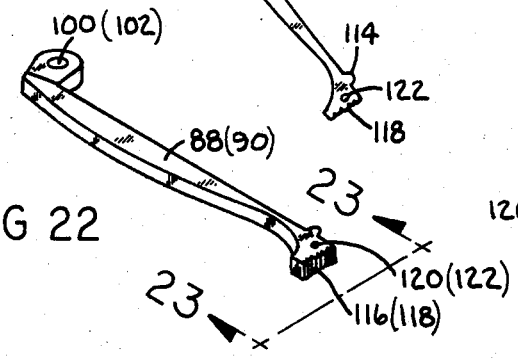
FIG. 22 is a detailed isometric view of one of the identical lock arms of the form of the invention shown in FIGS. 18–21.
Figure 23:
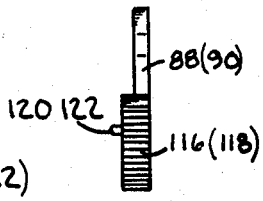
FIG. 23 is an end elevational view taken from the free end of the lock arm shown in FIG. 22.

FIGS. 1 and 2 are respective isometric and cross-sectional plan views of the first preferred embodiment of the cutlery apparatus according to the invention, FIG. 2 showing the apparatus in its locked and unlocked positions. FIGS. 2–14 depict the major components of the apparatus including the slotted handle 2, the tool holding member 8, the lock arm 34, and various double-ended cutting tools 24, 24A, 24B and 24C. FIGS. 15–17 are cross-sectional views of another embodiment of the cutlery apparatus according to the invention, FIG. 15 showing this apparatus in its locked and unlocked position. FIGS. 18–27 show another type of cutlery apparatus according to the present invention, involving two lock arms, with the cutting tool pivotally mounted at one end of the handle means and the lock arms pivotally mounted at the other end thereof, and including respectively identical handle sides and respectively identical lock arms. FIGS. 28–33 show additional forms of cutting tools usable with forms of the invention.

FIGS. 1, 2, 7, and 9 show a slotted handle 2, preferably fabricated from molded plastic, comprising a slot 6 and a base 4. Attached to the handle is a tool holding member 8 shown isometrically in FIG. 5. The tool holding member is U-shaped and has two arms 10 and 12 extending from the base of the U. It is preferably fabricated of thin sheet metal. The tool holding member is pivotally mounted in the handle by means of a pin 14 (FIG. 10) extending through holes 20 and 22 on the handle and holes 16 and 18 in the tool holding member. A cutting tool 24 (FIG. 2) is pivotally mounted at the other end of the tool holding member 8 to arms 10 and 12. Two pivot component means in the form of trunnions 28 stand out from the sides of the cutting tool 24 and fit into opposing pivot component means in the form of journals 30 and 31 in the arms 10 and 12 of the tool holding member 8. The trunnions 28 comprise the ends of a pin 26 fixedly press fit into a hole in the tool 24 and whose length exceeds the thickness of the tool 24 at the location of the hole by no more than the total thickness of arms 10 and 12 of the tool holding member 8 (see FIG. 11). This allows for rigid nesting of the tool and tool holding member in the handle in closed position and for free pivotability and quick interchangeabiity of the cutting tools with the apparatus in open position. As shown in FIG. 2, the tool holding member 8 may be pivoted about pin 14 so that it is disposed in the handle slot 6 in a first, closed position or may be pivoted to be primarily outside the handle slot 6 to a second, open position. In the open position the cutting tool 24 may be pivoted end for end or removed completely from the tool holding member 8. When the tool holding member 8 is pivoted into its first position inside the handle slot 6, the edges of the tool holding member arms 10 and 12, as well as the edge of the cutting tool 24, are flush against the handle slot base 4 at a point adjacent to the cutting tool mounting trunnions 28. A detent 50 protruding from the handle slot base 4 engages opposing depressions 32 in the tool holding member arms 10 and 12 and a depression 52 in the cutting tool to further retain the tool holding member 8 and the cutting tool 24 in position.

A lock arm 34 is provided to lock the tool holding member 8 and the cutting tool 24 in the first, closed position.

Figure 3:
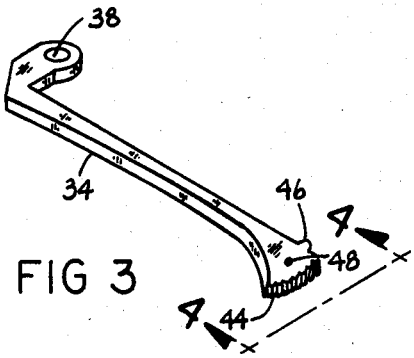
FIG. 3 is an isometric view of the lock arm on a slightly enlarged scale.
Figure 4:
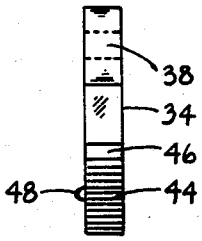
FIG. 4 is a further enlarged end view of the lock arm, taken along line 4—4 of FIG. 3.

FIG. 3 is an isometric view of the lock arm 34. The lock arm 34 is pivotally mounted in the handle by pivot component means in the form a pin 36 (FIG. 10) extending through holes 40 and 42 in the handle 2 and pivot component means in the form of a hole 38 in the lock arm 34. The lock arm 34 is pivotally movable about pin 36 from a locked position disposed within the handle slot 6 and in engagement with the tool holding member 8 and the cutting tool 24 when the tool holding member 8 is in its first position, to an open, unlocked position substantially clear of the slot 6. When the lock arm 34 is in its locked position, a portion thereof is flush against the edges of the tool holding member arms 10 and 12 and the edge of the cutting tool 24 at a point adjacent to the cutting tool mounting trunnions 28. A locking detent component in the form of protrusion 46 on the free end of lock arm 34 engages opposed depressions 33 in the tool holding member arms 10 and 12 and a locking detent component in the form of depression 54 in the side of the cutting tool 24 to further retain the tool holding member 8 and the cutting tool 24 in locked position.

Figure 11:
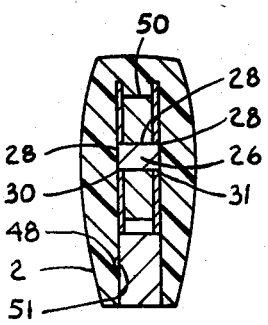
FIG. 11 is a cross-sectional view taken substantially along line 11—11 of FIG. 2.

The lock arm 34 is held in its closed position by means of a retainer component in the form of a raised portion 48 on the lock arm 34 that is perpendicularly oriented with respect to the detent 46 and which engages an opposing retainer component in the form of depression 51 in the side of the handle slot 6 (see FIG. 11). In order to facilitate the pivoting of the lock arm 34 from its locked position, a serrated surface 44 is provided at the outer end of the lock arm 34.

Figure 5:
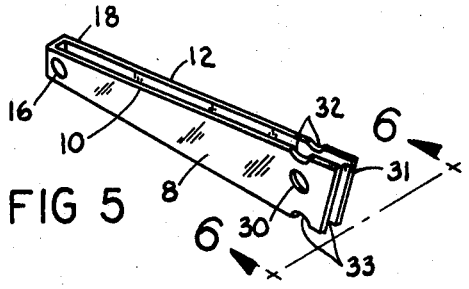
FIG. 5 is an isometric view of the tool holding member.
Figure 6:
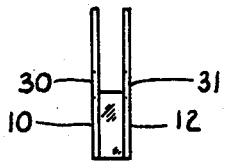
FIG. 6 is an end view on an enlarged scale of the tool holding member taken along line 6—6 of FIG. 5.
Figure 7:
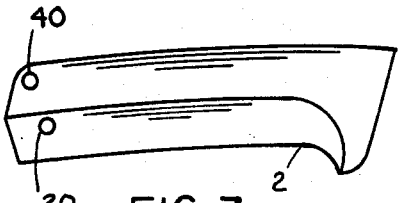
FIG. 7 is a plan view of the handle.
Figure 8:
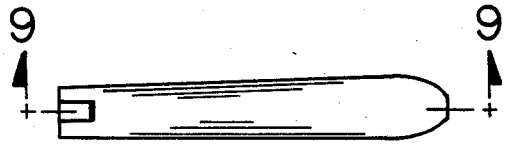
FIG. 8 is a top view of the handle.
Figure 9:
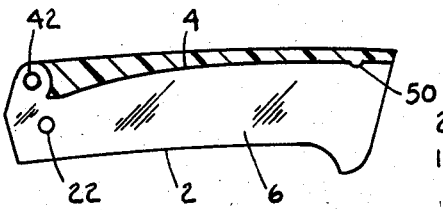
FIG. 9 is a cross-sectional view of the handle taken along line 9—9 of FIG. 8.
Figure 10:
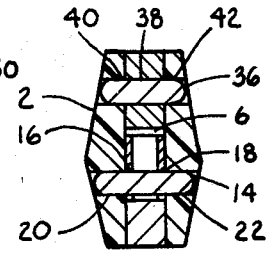
FIG. 10 is a cross-sectional view taken substantially along line 10—10 of FIG. 2.
Figure 5A:
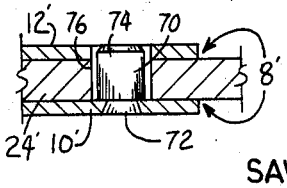
FIG. 5A is a fragmentary cross-sectional view on an enlarged scale of a modified form of tool holder, similar to that shown in FIG. 5, except provided with a pin of cylindrical form to serve as the pivot component when the tool element is of a form having a centrally placed hole as the pivot component, rather than a centrally placed pin means at the pivot component.

FIG. 5 is a detail showing of the tool holding member 8, wherein the pivot component means by which the cutting tool 24 is mounted for pivotal movement and is readily removable and interchangeable is in the form of pivot holes 30, receiving pivot component means in the form of pin 28 on the cutting tool 24. As will be apparent, the forms of the respective pivot component means can be readily reversed, such as shown in FIG. 5A, wherein the tool holder 8′ is configured so that one of its sides 10′ carries a pin 70, mounted thereon by crimping 72, the free end 74 of which slidably fits within hole 76 in the other arm 12′ when the arms 10′, 12′ are in parallel juxtaposition as shown. With a pin type pivot component on the arms of the tool holder 8′, the corresponding configuration of the cutting tool 24′ is with its pivot component means simply a hole, i.e. with pin 28 removed or in fact never installed, which has the advantage of simplifying the fabrication of the cutting tool. As will also be evident, this variation of the cutting tool, involving a pivot hole rather than a pivot pin, is equally applicable to all forms of cutting tools disclosed. As will also be apparent, a reversal of the configuration of interfitting parts can also be made with respect to the locking detent components on a lock arm, specifically protrusion 46 on the locking arm 34 and protrusion 50 on the handle base 4 on the one hand, and respective recesses 54, 52 on the cutting tool, on the other hand. However, in the instance of such locking detent components, it is considered preferable to utilize the forms of cutting tools illustrated, i.e. with the locking detent components in the cutting tool as recesses, since such configuration is advantageous from the point of view of simplicity of fabrication of the cutting tools.

Figure 12:
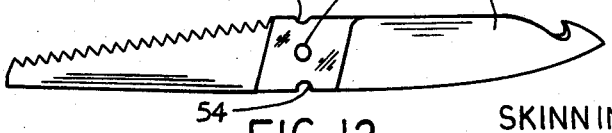
FIG. 12 is a plan view of a further form of double-ended cutting tool for use in the apparatus of the present invention, and comprising a saw on one end and gut hook/skinning blade combination on the other end.
Figure 13:
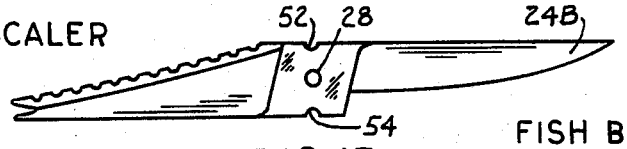
FIG. 13 is a plan view of another form of such double-ended cutting tool, comprising a fish descaler and hook remover on one end and a fish blade on the other.
Figure 14:
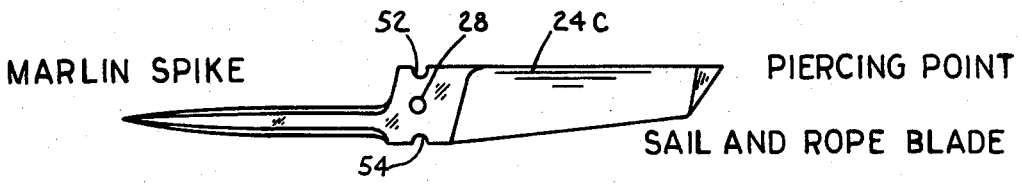
FIG. 14 is a plan view of yet another form of such double-ended cutting tool, comprising a marlin spike on one end and a snail and rope blade in combination with a piercing point on the other.

FIGS. 12, 13, and 14 show representative double ended cutting tools of various forms for use as a set of cutting tools, each placeable in the tool holder and handle shown in FIGS. 5–9, in accordance with the invention. FIG. 12 shows a cutting tool 24A comprising a saw on one end and a gut hook-skinning blade combination on the other end. FIG. 13 shows a cutting tool 24B comprising a fish descaler and hook remover on one end and a fish blade on the other. FIG. 14 shows a cutting tool 24C comprising a marlin spike on one end and a sail and rope blade in combination with a piercing point on the other. As will be apparent, all of these tools comprise pivot component means in the form of trunnions 28, for example, and locking detent component means in the form of depressions 52, 54, for example, and are of a configuration to be interchangeable with the double bladed cutting tool 24 and with each other.

FIGS. 15, 16, and 17 are respective cross-sectional plan views and cross-sectional views of another embodiment of the cutting apparatus according to the invention, FIG. 15 showing the apparatus in its closed or locked condition in solid line and its open or unlocked condition in broken line. This embodiment utilizes two mounted, single-ended knife blades 58 rather than the single double-ended cutting tool 24, 24A, 24B or 24C used in the first embodiment. In this embodiment, the handle slot 6 is of a width to accommodate the desired number of blades 58. These blades 58 are single ended, i.e. they pivot about one end, and are otherwise similar to the cutting tool 24 of the first preferred embodiment except that they have a hole 66 at the pivot point instead of the trunnions 28. The cutting blades 58 are mounted on the arms 10 and 12 of the tool holding member 8 by means of an internally threaded removable screw 62, extending through a hole 30 (cf. FIG. 5) in the arm 10 of the tool holding member 8 and holes 66 of the knife blades and 61 of the spacer 60, and threading onto an externally threaded removable screw 64 extending through hole 31 in the other arm 12 of the tool holding member 8.

When the tool holding member 8 is in its open position primarily outside the handle slot 6, the knife blades 58 may be pivoted in or out of position for use or may be removed from the tool holding member 8 simply by unthreading screws 62 and 64. The apparatus is returned to its locked position in the same manner as in the above discussed first embodiment, i.e. by first pivoting the tool holding member 8 into its first position disposed within the handle slot 6 and then pivoting the lock arm 34 into its locked position in engagement with the tool holding member 8 and the knife blades 58. As will be apparent, in such locked position the knife blades 58 are locked in fixed position with respect to the handle whether in their extended position for use or in their nested position in the handle, the blades being rigidly and fixedly retained with respect to the handle by reason of detent 50 in the handle engaging the depressions 52 or 54 on the knife blades 58, with detent 46 on the lock arm likewise engaging the other of depressions 52, 54 on the knife blades 58, and with the U-shaped tool holding member 8 with interposed blades 58 and spacer 60 snugly fitting within the sides of handle 2 (FIG. 16). Such manner of positive locking of a blade in its position of use or in its nested position with respect to the associated handle is to be distinguished from the conventional arrangement commonly used in pocket knives and the like where the blade in its use position, and in its closed position as well, is simply retained in such position by spring loading and can be deflected from such position by side loading, which on occasion can cause accidental injury to the user. As will also be apparent, while the apparatus arrangement shown in FIGS. 15–17 involves two single-ended knife blades, the arrangement can involve more than two such blades or like cutting tools, each of like configuration at the pivoted end, or can involve but a single single-ended cutting tool of like configuration, which arrangement then can readily be identical to that shown in FIGS. 2–11 except that one end of the cutting tool is not present.

A second preferred form of the invention is illustrated in FIGS. 18–25, wherein the handle, generally indicated at 80, in which the preferably double-ended cutting tool, generally indicated at 82 is reversibly and removably retained, comprises two identical slab handle sides 84, 86 and two identical lock arms 88, 90. The cutting tool 84 is in its central portion of the same configuration as earlier discussed in connection with the first preferred form of the invention at FIG. 5A, i.e. with a centrally placed pivot component means in the form of a hole 28' and locking detent component means at the sides of the tool in the form of recesses 52, 54. The cooperating pivot component means mounting the cutting tool 24 for pivotal movement with respect to the handle sides 84, 86, in the form of the invention shown in FIGS. 18–25, is in the form of a double-headed bolt made up of a female threaded major component 92 and a male threaded minor component 94, the head end of each of which is slotted as at 96, 98 (FIG. 21) for ease of assembly and disassembly.

The lock arms 88, 90 in this form of the invention are mounted for pivotal movement at the other end of the handle sides 84, 86 by similar pivot component means including respective pivot components in the form of holes 100, 102 in the arms 88, 90 and a pivot component means in the form of a double-headed bolt having a female threaded major portion 104 (FIG. 25) and a male threaded minor portion 106, such head portions 104, 106 being respectively slotted as at 108, 110 for ease of assembly and disassembly. In like manner as the lock arm 34 (FIG. 3) in the first form of the invention discussed, the free ends of arms 88, 90 are provided with locking detent components in the form of protrusions 112, 114 (like protrusion 46 in FIG. 3) which engage one or the other of the locking detent components in the form of depressions 52, 54 in the sides of the cutting tool 82 when the cutting tool 82 is in its position of use and the lock arms are closed thereagainst (FIG. 11). Second lock arms 88, 90, in like manner as at surface 44 in FIG. 3, are provided with serrated surfaces 116, 118 to facilitate the movement thereof to and from tool locking position. Similarly also, each of the lock arms 88, 90 includes a retainer component 120, 122 that is perpendicularly oriented with respect to the respective locking components 112, 114 and each of which engages an opposing retainer component in the form of a depression 124, 126 (FIG. 11) in the respective handle portions 84, 86.

As will be apparent, the form of apparatus shown in FIGS. 18–25 is readily partly disassembable to reverse a given cutting tool end for end or to replace such, or partly or fully disassembable such as for cleaning. Also, the construction thereof is strong and rigid, with the cutting tool locked in a position of use, in that the handle parts are bolted together at both ends of the handle and the tool is in rigid, locked position by the respective locking detent components 112, 114, 52, 54 being interengaged and the respective locking arms 88, 90 being retained in locking position by retainer components 120, 122, 124, 126 and by the grip of the user around the handle including the closed lock arms 88, 90.

FIGS. 26 and 27 illustrate a further variation of cutlery apparatus according to the present invention, like that shown in FIGS. 18–23 except as to the detail of the double-headed bolt holding the butt end of the handle sides 84', 86' and the pivoted ends of the lock arms 88', 90' together. In this instance, the double-headed bolt comprising a major female threaded portion 104' and a minor male threaded portion 106' is of relatively larger diameter and provided with a central bore or aperture 130, 132 through which may be threaded a wrist lanyard or the like to facilitate use of the cutlery apparatus, such as when used by scuba divers underwater. Slots 134, 136 are provided in the respective heads 104', 106' for ease of assembly and disassembly.

FIGS. 28–33 show representative double-ended cutting tools of various forms for use as a set of cutting tools, each mountable in the handle 80 of the form of the invention shown in FIGS. 18–25 and also mountable in the first form of the invention discussed involving the pivot pin mounted in a tool holder (as in FIG. 5A). FIGS. 28 and 29 are respective side and edge views a cutting tool 82A comprising a chisel at one end, a line cutter along a side of the same end, a blade at the other end and the saw segment along on the side of the blade, the cutting tool including a central pivot hole 28' as its pivot component and recesses 52, 54 placed laterally of the pivot hole at the sides of the tool in like manner as the cutting tool 82 shown at FIG. 19, for example. FIGS. 30 and 31 are respective side and edge views of a cutting tool 82B comprising a chisel at one end and a saw segment along one side of the same end, with a blade at the other end with a line cutter along the side thereof, the central portion of the cutting tool again including a central pivot hole 28' and side locking detent recesses 52, 54. Like central construction involving a pivot hole 28' and side recesses 52, 54 are also provided in cutting tool 82C shown in the side view of FIG. 32 and edge view of FIG. 33, wherein a chisel is provided at one end of the tool with a heavy blade along one side of the same end, and the other end of the tool is provided with a blade with a line cutter along one side thereof. As will be apparent, all of these blades are of like construction in the central portion thereof and like overall dimensioning so as to be interchangeable.

Figure 34:
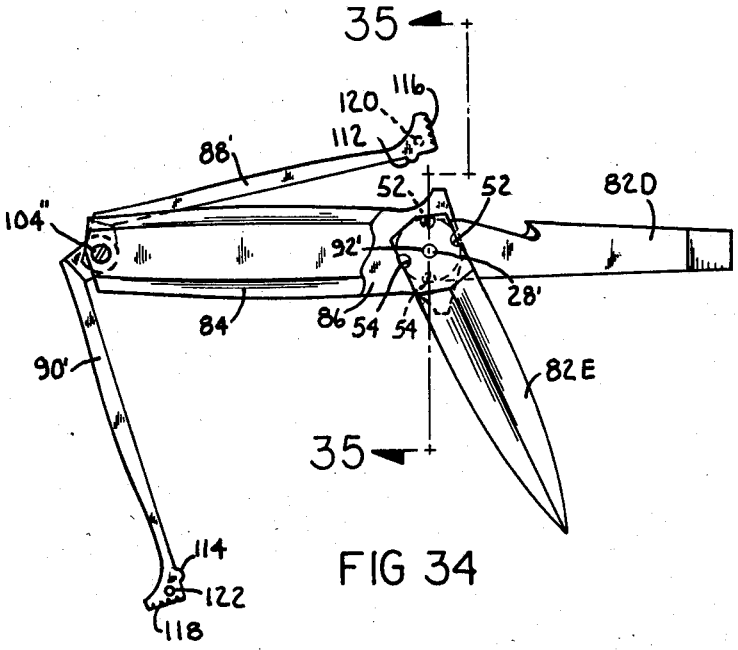
FIG. 34 is a plan view, partly in cross section, of a further modified form of the invention, incorporating plural, single-ended cutting tools, and in that sense similar to the form shown at FIG. 15, together with two lock arms, and in that sense similar to the embodiment of the invention shown at FIG. 19.
Figure 35:
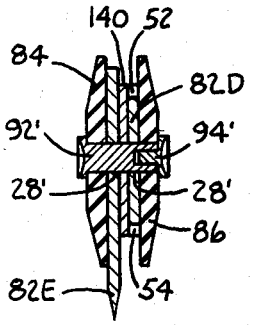
FIG. 35 is a cross-sectional view taken substantially along line 35—35 of FIG. 34.

As further variations of the handle and blade configurations contemplated by the present invention, it will be evident that any of the tools illustrated in FIGS. 12–14, 19 and 28–33 may be made single ended and used in plurality in like manner as the tools 58 in the form of the invention illustrated at FIGS. 15–17, with a pivot component laterally centered at one end thereof and with side placed locking detent components 52, 54. Such a variation involving two single-ended tools 82D and 82E is shown in FIGS. 34 and 35, wherein the tools 82D, 82E each comprises pivot component holes 28', and locking detent components 52, 54, the tools 82D, 82E, separated by a thin washer 140 being pivotally arranged on handle sides 84, 86 by means of double-headed bolt 92', 94', the respective locking detent components 52, 54 being engageable by respective locking detent components 112, 114 of lock arms 88', 90', which are in turn pivotally mounted on the handle sides 84, 86 by double-headed bolt means including major bolt portion 104'', said lock arms 88', 90' being also provided with serrated surfaces 116, 118 and retainer components 120, 122 in like manner as lock arms 88, 90 of the form of the invention shown at FIGS. 18–25. As will be readily understood, each of the tools 82D, 82E) is pivotally movable into a use position (tool 82D as shown) and into a non-use or enclosed position entirely between the handle sides 84, 86, so that either one of the tools 82D, 82E can be placed in the use position, with the other in the non-use position, or both are pivotally moved into the non-use, nested position, with the lock arms being closable and the locking means 52, 54, 112, 114 being interengageable in any such arrangement.

It is an important advantage of the cutlery apparatus of the present invention that it is readily disassemblable for cleaning or the like. To this end, as in the embodiment shown in FIGS. 2–11 for example, the pivot pin 14 of the tool holding member 8 and the pivot pin 36 of the lock arm 34 are of a size to snugly fit in the respective holes 20 and 40 of the handle member 2 and are removable therefrom by hand pressure applied through suitable means such as a nail or awl. Removal of these pins along with removal of the cutting tool from the tool holding member provides complete disassembly of all the major parts so they may be more readily and more completely cleaned than is the case with a conventional folding knife. similarly, in the embodiment of the invention shown in FIGS. 18–25, and in the variation thereof shown at FIGS. 26 and 27 as well, the components of the apparatus are fully disassembable simply by disassembly of the double-headed bolt means 92, 94 and 104, 106 (or 104', 106') for cleaning and/or tool interchange.

As will be recognized, various other modifications and adaptations of the apparatus are possible within the scope of the invention as defined by the following claims.

What is claimed is:

1. Cutlery apparatus comprising:

a handle having a longitudinally extending slot formed therein;

a cutting tool positionable in said slot;

a generally U-shaped tool holding member having two relatively long, flexible arms;

first mounting means pivotally mounting the base end of the tool holding member to one end of the handle along a first axis transverse to the principal plane of the handle slot, said tool holding member being pivotable from a first position disposed within the handle slot and oriented such that the arms of the tool holding member are parallel to and in engagement with the sides of the handle slot and a longest dimension of each arm is parallel to a longest dimension of said slot, to a second position primarily outside said slot with said arms primarily clear of the sides of said slot;

second mounting means pivotally mounting the cutting tool on the arms of the tool holding member along a second axis parallel to said first axis and situated at the other end of the tool holding member;

a lock arm;

third mounting means mounting one end of the lock arm on the handle for pivotable movement about a thrid axis adjacent and parallel to said first axis, said lock arm being pivotable to and from a locked position in engagement with said tool holding member when the latter is in its first position disposed within said handle slot, and an open, unlocked position primarily clear of said handle and slot; and means for positively locking said lock arm in place in its first position to fixedly retain said tool holding member and cutting tool in said handle.

2. Cutlery apparatus as in claim 1, wherein said second mounting means comprises pivot component means on said cutting tool interfitting with pivot component means in the arms of said tool holding member.

3. Cutlery apparatus as in claim 2, wherein said pivot component means on the cutting tool comprises a pivot pin press fit into a hole in the cutting tool and whose length exceeds the thickness of the cutting tool at the location of said hole by no more than the total thickness of the tool holding member arms and which does not extend beyond the outer faces of the arms of the tool holding member when the cutting tool is mounted thereon.

4. Cutlery apparatus as in claim 1, wherein said tool holding member is fabricated of thin sheet metal.

5. Cutlery apparatus as in claim 1, wherein said first mounting means includes pin means in the handle, about which the tool holding member is pivotally movable.

6. Cutlery apparatus as in claim 1, wherein said third mounting means includes pivot means in the handle, about which the lock arm is pivotally movable.

7. Cutlery apparatus as in claim 1, wherein said means for locking the lock arm in its first position includes retainer means acting perpendicularly of the principal plane of the handle slot.

8. Cutlery as in claim 1, wherein the cutting tool and tool holding member have recesses one each edge for accepting opposing projections respectively located on the base of the handle slot and the lock arm when the tool holding member is in its first position and the lock arm is in its locked position.

9. Cutlery as in claim 1, wherein said lock arm comprises a serrated surface for ease of movement of the lock arm out of its first, locked position.

10. Cutlery apparatus comprising:

a handle having a longitudinally extending slot formed therein;

single ended knife blade means positionable in said slot;

a generally U-shaped tool holding member having two relatively long, flexible arms;

first mounting means pivotally mounting the base end of the blade holding member to one end of the handle along a first axis transverse to the principal plane of the member being pivotable from a first position disposed handle slot, said blade holding within the handle slot and oriented such that the arms of the blade holding member are parallel to and in engagement with the sides of the handle slot and a longest dimension of each arm is parallel to a longest dimension of said slot, to a second position primarily outside said slot and with said arms primarily clear of the sides of said slot;

second mounting means pivotally mounting the single ended knife blade means on the arms of the blade holding member along a second axis parallel to said first axis and situated at the other end of the blade holding member;

a lock arm;

third mounting means mounting one end of the lock arm to the handle for pivotable movement about a third axis adjacent and parallel to said first axis, said lock arm being pivotable to and from a locked position in engagement with said blade holding member when the latter is in its first position disposed within said handle slot, and an open, unlocked position primarily clear of said handle and slot; and means for positively locking said lock arm in place in its first position to fixedly retain said blade holding member and single ended knife blade means in said handle.

11. Cutlery as in claim 10, comprising two single-ended knife blades, and wherein the second mounting means includes a removable headed bolt part with internal threads threading onto an externally threaded removable headed bolt part about which the blades are pivotally movable.

12. Cutlery apparatus as in claim 10, wherein the first mounting means includes pivot means snugly fit into the handle and about which the blade holding member is pivotally movable.

13. Cutlery apparatus as in claim 10, wherein the third mounting means includes pivot means snugly fit into the handle and about which the lock arm is pivotally movable.

14. The cutlery apparatus as in claim 10, wherein said means for locking the lock arm in its first position includes a retainer means acting perpendicularly of the principal plane of the handle slot and fitting into an opposing depression in the side of the handle slot.

15. Cutlery apparatus as in claim 10, wherein the single ended knife blade means and blade holding member have depressions on each edge for accepting opposing projections respectively located on the base of the handle slot and the lock arm when the blade holding member is in its first position and the lock arm is in its locked position.

16. Cutlery apparatus as in claim 10, wherein said lock arm has a serrated surface thereon facilitating movement of the lock arm out of its first, locked position.

17. Cutlery apparatus comprising:

a handle having a longitudinally extending slot formed therein;

a double-ended knife blade positionable in said slot;

a generally U-shaped tool holding member having two relatively long, flexible arms;

first mounting means pivotally mounting the base end of the blade holding member at one end of the handle along a first axis transverse to the principal plane of the handle slot, said blade holding member being pivotable from a first position disposed within the handle slot and oriented such that the arms of the blade holding member are parallel to and in engagement with the sides of the handle slot and a longest dimension of each arm is parallel to a longest dimension of said slot, to a seocnd position primarily outside said slot with said arms primarily clear of the sides of said slot;

second mounting means mounting the double-ended knife blade on the arms of the blade holding member for pivotal movement about a second axis parallel to said first axis and situated at the other end of the blade holding member;

a lock arm;

third mounting means mounting one end of the lock arm to the handle for pivotable movement about a third axis adjacent and parallel to said first axis, said lock arm being pivotable to and from a locked position in engagement with said blade holding member when the latter is in its first position disposed within said handle slot, and an open, unlocked position primarily clear of said handle and slot; and means for positively retaining said lock arm in place in its first position to fixedly retain said blade holding member and double-ended knife blade in said handle.

18. Cutlery apparatus as in claim 17, wherein said second mounting means includes pivot pin means interfit between the double-ended knife blade and the arms of said blade holding member.

19. Cutlery apparatus as in claim 18, wherein said pivot pin means comprises a pin press fit centrally into the double-ended knife blade and holes in the arms of the blade holding member.

20. Cutlery apparatus as in claim 17 wherein said blade holding member is fabricated of thin sheet metal.

21. Cutlery apparatus as in claim 17, wherein said first mounting means includes pin means in the handle and about which the blade holding member is pivotally movable.

22. Cutlery apparatus as in claim 17, wherein said means for locking the lock arm in its first position includes retainer means acting perpendicularly of the principal plane of the handle slot.

23. Cutlery apparatus as in claim 17, wherein the double-ended knife blade and blade holding member comprise recesses on the edge of each for accepting opposing projections respectively located on the base of the handle slot and the lock arm when the blade holding member is in its first position when the lock arm is in its locked position.

24. Cutlery apparatus as in claim 17, wherein said lock arm has a serrated surface thereon facilitating movement of the lock arm.

* * * * *

UNITED STATES PATENT AND TRADEMARK OFFICE
CERTIFICATE OF CORRECTION

PATENT NO. : 4,606,123

DATED : August 19, 1986

INVENTOR(S) : Robert A. Wrench

It is certified that error appears in the above-identified patent and that said Letters Patent are hereby corrected as shown below:

Column 11: line 53, "thrid" should read -- third --.

Column 12: line 21, "one" should read -- on --; lines 39-40, "of the member being pivotable from a first position disposed handle slot, said blade holding" should read -- of the handle slot, said blade holding member being pivotable from a first position disposed --.

Column 13: line 46, "seocnd" should read -- second --.

Signed and Sealed this

Fourth Day of November, 1986

[SEAL]

*Attest:*

DONALD J. QUIGG

*Attesting Officer*

*Commissioner of Patents and Trademarks*